US010276272B2

(12) United States Patent
Benson et al.

(10) Patent No.: US 10,276,272 B2
(45) Date of Patent: Apr. 30, 2019

(54) PROTECTION DEVICES FOR GAMMA RADIOGRAPHY

(71) Applicant: QSA Global Inc., Burlington, MA (US)

(72) Inventors: Paul F. Benson, Waltham, MA (US); Jack Crosby, Concord, MA (US)

(73) Assignee: QSA GLOBAL INC., Burlington, MA (US)

( * ) Notice: Subject to any disclaimer, the term of this patent is extended or adjusted under 35 U.S.C. 154(b) by 0 days.

(21) Appl. No.: 15/514,076

(22) PCT Filed: Sep. 14, 2015

(86) PCT No.: PCT/US2015/049886

§ 371 (c)(1),
(2) Date: Mar. 24, 2017

(87) PCT Pub. No.: WO2016/053601

PCT Pub. Date: Apr. 7, 2016

(65) Prior Publication Data

US 2017/0294244 A1 Oct. 12, 2017

Related U.S. Application Data

(60) Provisional application No. 62/058,287, filed on Oct. 1, 2014.

(51) Int. Cl.
*G21F 5/015* (2006.01)
*G21F 3/00* (2006.01)
(Continued)

(52) U.S. Cl.
CPC ..... *G21F 3/00* (2013.01); *G21F 1/08* (2013.01); *G21F 5/015* (2013.01); *G21F 5/02* (2013.01);
(Continued)

(58) Field of Classification Search
CPC .... G21F 3/00; G21F 5/00; G21F 1/08; G21K 1/04; G21G 4/04
See application file for complete search history.

(56) References Cited

U.S. PATENT DOCUMENTS 3,697,755 A * 10/1972 Boissevain ..... G21F 5/02 250/496.1
5,735,463 A 4/1998 Osada et al.
(Continued)

FOREIGN PATENT DOCUMENTS

CN 101612448 12/2009
CN 102347088 2/2012
(Continued)

OTHER PUBLICATIONS

ISR & WO for PCT/US2015/049886 dated Mar. 15, 2016.

*Primary Examiner* — Eliza W Osenbaugh-Stewar
(74) *Attorney, Agent, or Firm* — McCarter & English, LLP

(57) ABSTRACT

The present disclosure relates to a radiographic shield incorporating a radiographic shutter mechanism, and a protective jacket for a radiographic device. The radiographic shutter mechanism includes machined tungsten components which in some embodiments, includes a jigsaw puzzle type interconnection, the radiographic shield includes an S-shaped passageway in combination with the radiographic shutter mechanism. The protective jacket allows for various mounting configurations, such as integrated SCAR mounting configurations, including a ratchet snap configuration.

9 Claims, 7 Drawing Sheets

(51) Int. Cl.

| | |
|---|---|
| ***G21F 5/02*** | (2006.01) |
| ***G21F 5/04*** | (2006.01) |
| ***G21H 5/00*** | (2006.01) |
| ***G21F 1/08*** | (2006.01) |
| *G21G 4/04* | (2006.01) |
| *G21K 1/04* | (2006.01) |

(52) U.S. Cl.
CPC ..... *G21F 5/04* (2013.01); *G21H 5/00* (2013.01); *G21G 4/04* (2013.01); *G21K 1/04* (2013.01)

(56) References Cited

U.S. PATENT DOCUMENTS

| | | | | |
|---|---|---|---|---|
| 6,190,303 | B1 * | 2/2001 | Glenn | G21F 5/018 600/1 |
| 6,781,114 | B1 | 8/2004 | Grenier | |
| 2008/0203330 | A1 | 8/2008 | Danciu et al. | |
| 2009/0039575 | A1 | 2/2009 | Umemoto et al. | |
| 2009/0283703 | A1 * | 11/2009 | Tamura | A61N 5/1048 250/492.3 |
| 2011/0309272 | A1 | 12/2011 | Cole | |
| 2012/0187316 | A1 | 7/2012 | Mayfield et al. | |
| 2012/0305800 | A1 * | 12/2012 | Mayfield | A61N 5/1001 250/432 PD |
| 2013/0334443 | A1 | 12/2013 | Steel et al. | |

FOREIGN PATENT DOCUMENTS

| | | | |
|---|---|---|---|
| CN | 102985981 | | 3/2013 |
| CN | 107077898 | | 8/2017 |
| EP | 1959157 | A1 | 8/2008 |
| GB | 2299558 | A | 10/1996 |
| WO | 0231834 | A1 | 4/2002 |

* cited by examiner

PROTECTION DEVICES FOR GAMMA RADIOGRAPHY

RELATED APPLICATIONS

This application is a national phase of International Application Number PCT/US2015/049886 filed Sep. 14, 2015 and claims priority of U.S. Provisional Application No. 62/058,287, filed on Oct. 1, 2014. The contents of all of the above-identified applications are hereby incorporated by reference in their entirety and for all purposes.

BACKGROUND OF THE DISCLOSURE

Field Of The Disclosure

The present disclosure relates to a radiographic shield with an S-shaped passageway, further incorporating a radiographic shutter mechanism, and a protective jacket for a radiographic device.

Description of the Prior Art

In the prior art, the need for protection in the field of gamma radiography is well-established and self-evident. Improvements are continually sought which maintain radiographic safety but which are more economical and less cumbersome to use, as well as providing for efficient work procedures.

For example, traditional tungsten shields need to be either a machined straight tube design or an S-tube design. The straight tube design can be machined using conventional machining methods but this design requires shielding attached to the front of the source or source assembly. This design limits the types of radiography that can be performed. S-tube designs typically require a casting process which can be expensive and may produce voids within the material which can reduce shielding efficiency Similarly, traditional tungsten shields need to be either a machined "straight tube" design or an "S" tube design. The straight tube design can be machined using conventional machining methods but this design requires shielding attached to the front of the source. This may limit the types of radiography that can be performed.

Finally, the prior art includes protective jackets for radiographic devices which uses a metal handle. However, this is less ergonomic than desired, and typically does not include mounting features.

SUMMARY OF THE DISCLOSURE

The disclosure relates to various devices in the field of protection in gamma radiography. The disclosure relates to interlocking shielding and a source path within a gamma radiography shield, and a protective jacket for a gamma radiography device.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENT

Figure 1A:
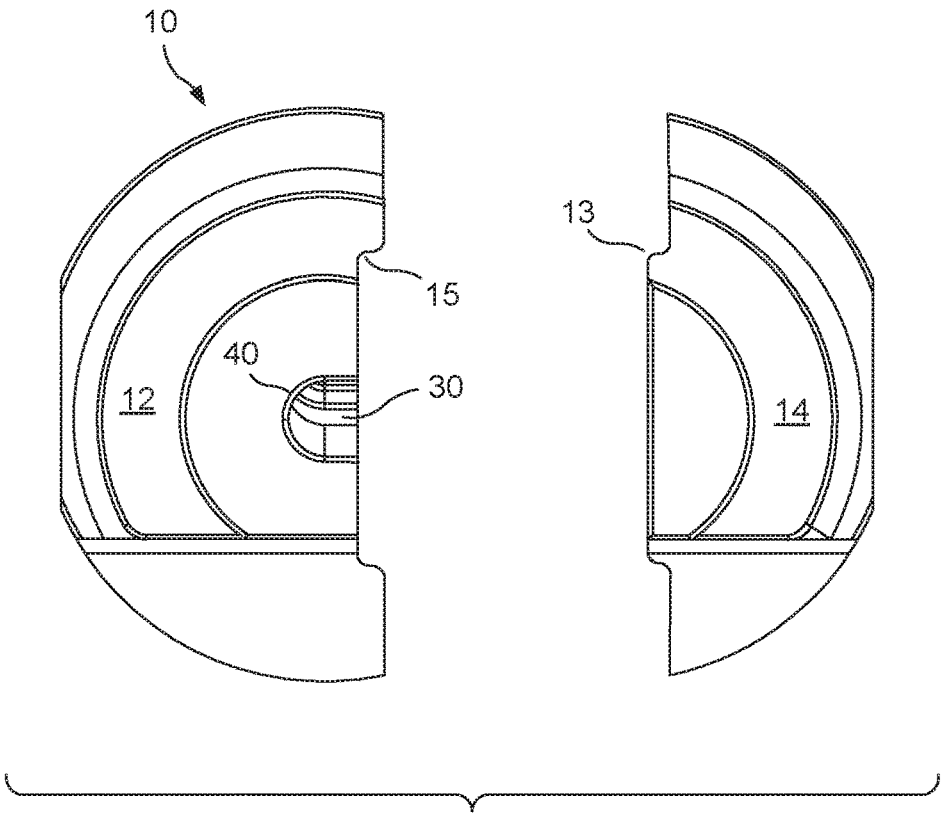
FIG. 1A is a front perspective view of the two parts of a first embodiment of the interlocking shield of the present disclosure, shown in a separated configuration.
Figure 1B:
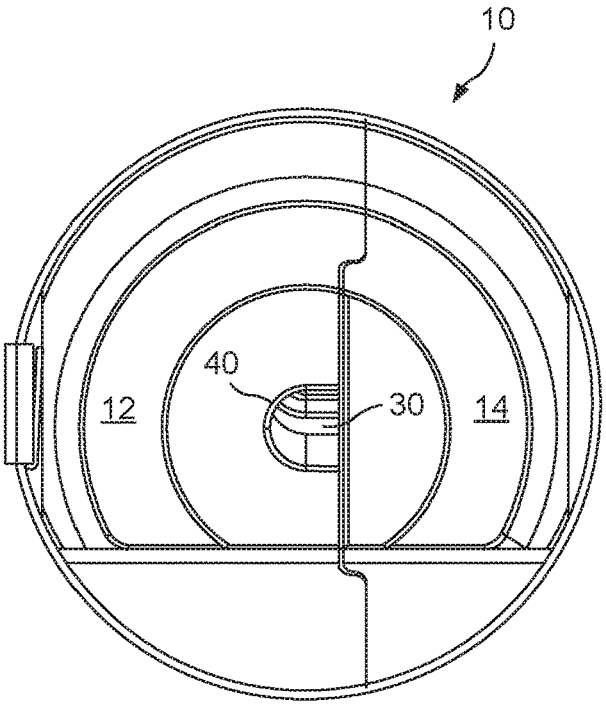
FIG. 1B is a front perspective view of the two parts of a first embodiment of the interlocking shield of the present disclosure, shown in an assembled configuration.

Referring now to FIGS. 1A and 1B, one sees a first embodiment of an interlocking shield 10 for gamma radiography. In this embodiment, typically, a single piece of tungsten is machined into first and second halves 12, 14 using wire EDM (electrical discharge machining). First half 12 includes a longitudinally-oriented indentation 15 which receives the longitudinally oriented ridge 13 of second half 14. End 40 of source path 30 (described in greater detail with respect to FIGS. 3 and 4) opens on first half 12.

Figure 2A:
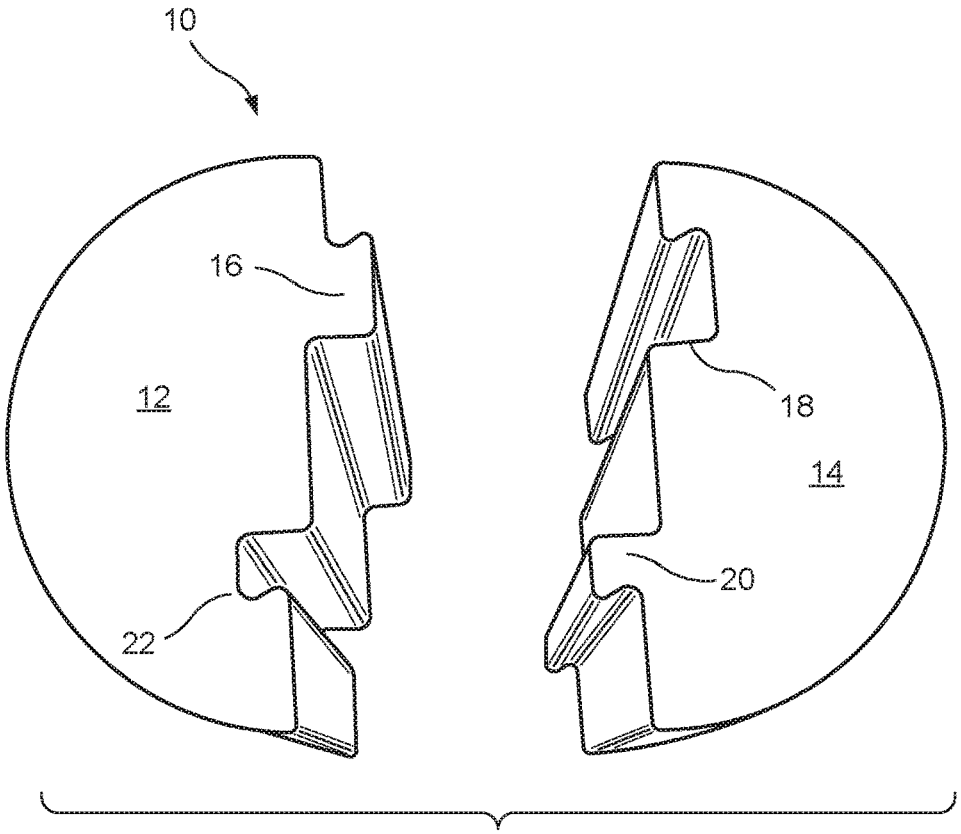
FIG. 2A is a front perspective view of the two parts of a second embodiment of the interlocking shield of the present disclosure, shown in a separated configuration.
Figure 2B:
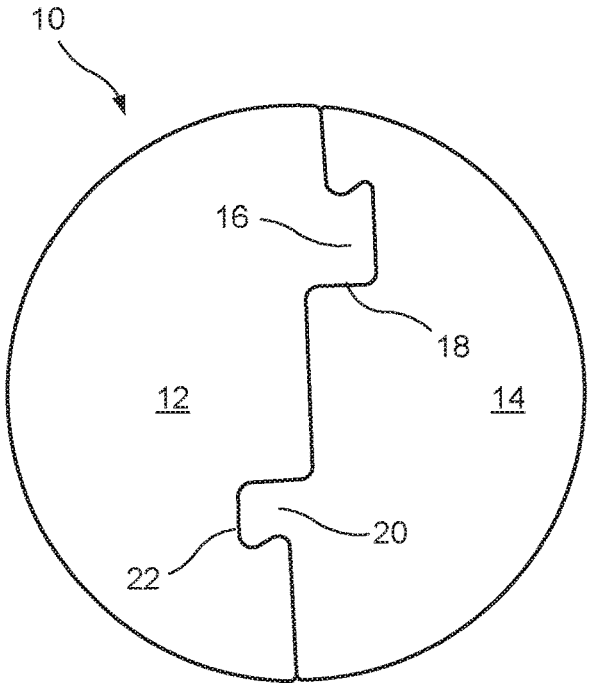
FIG. 2B is a front perspective view of the two parts of a second embodiment of the interlocking shield of the present disclosure, shown in an assembled configuration.

An alternative embodiment is illustrated in FIGS. 2A and 2B. This embodiment has jigsaw puzzle type characteristics in the opposing portions of the outline of the first and second halves 12, 14 with first half 12 including a first protrusion 16 which tightly interlocks into second undercut recess 18 of second half 14. Likewise, second half 14 includes a second protrusion 20 which tightly interlocks into first undercut recess 22 of first half 12. The pattern creates an interlocking feature which limits the assembly to a single degree of freedom for an extremely strong assembly typically without the need for bolting the first and second halves 12, 14 to each other. This pattern also improves the radioactive shielding by allowing the use of offset overlapping joints which reduces the direct path of the gamma radiation. By the use of separate first and second halves 12, 14, the source path 30 can be machined into each half. This allows for unique source path shapes to be created typically without the need to cast the tungsten. The ability to remove and disassemble the shield allows for inspection and maintenance.

This design thereby takes advantage of the radiological shielding properties of machined tungsten while allowing maximum joint design, secure interlocking and provides the ability to machine unique source paths within the shield 10.

Figure 3:
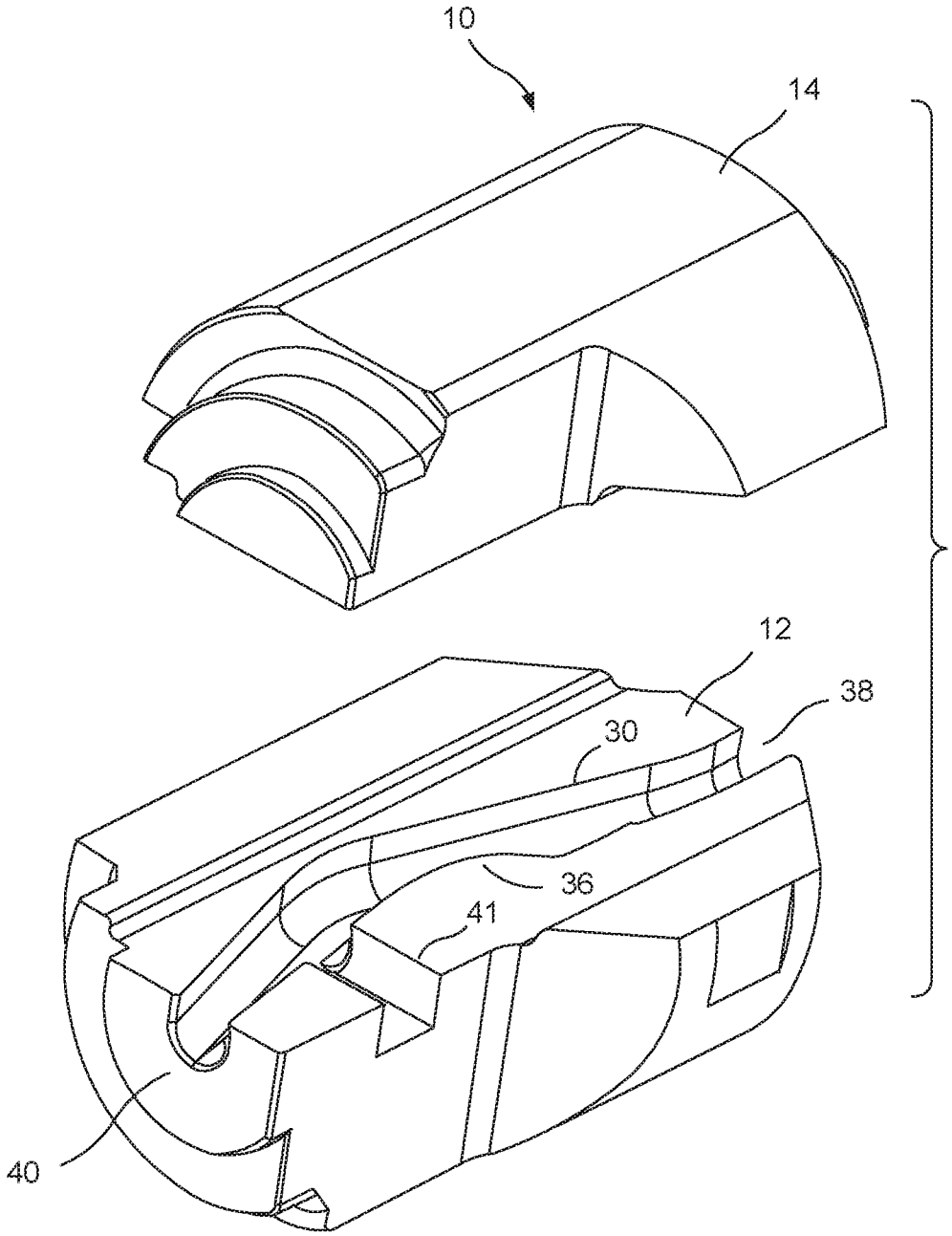
FIG. 3 is a side cross-sectional view of an embodiment of the source path of the present disclosure.
Figure 4:
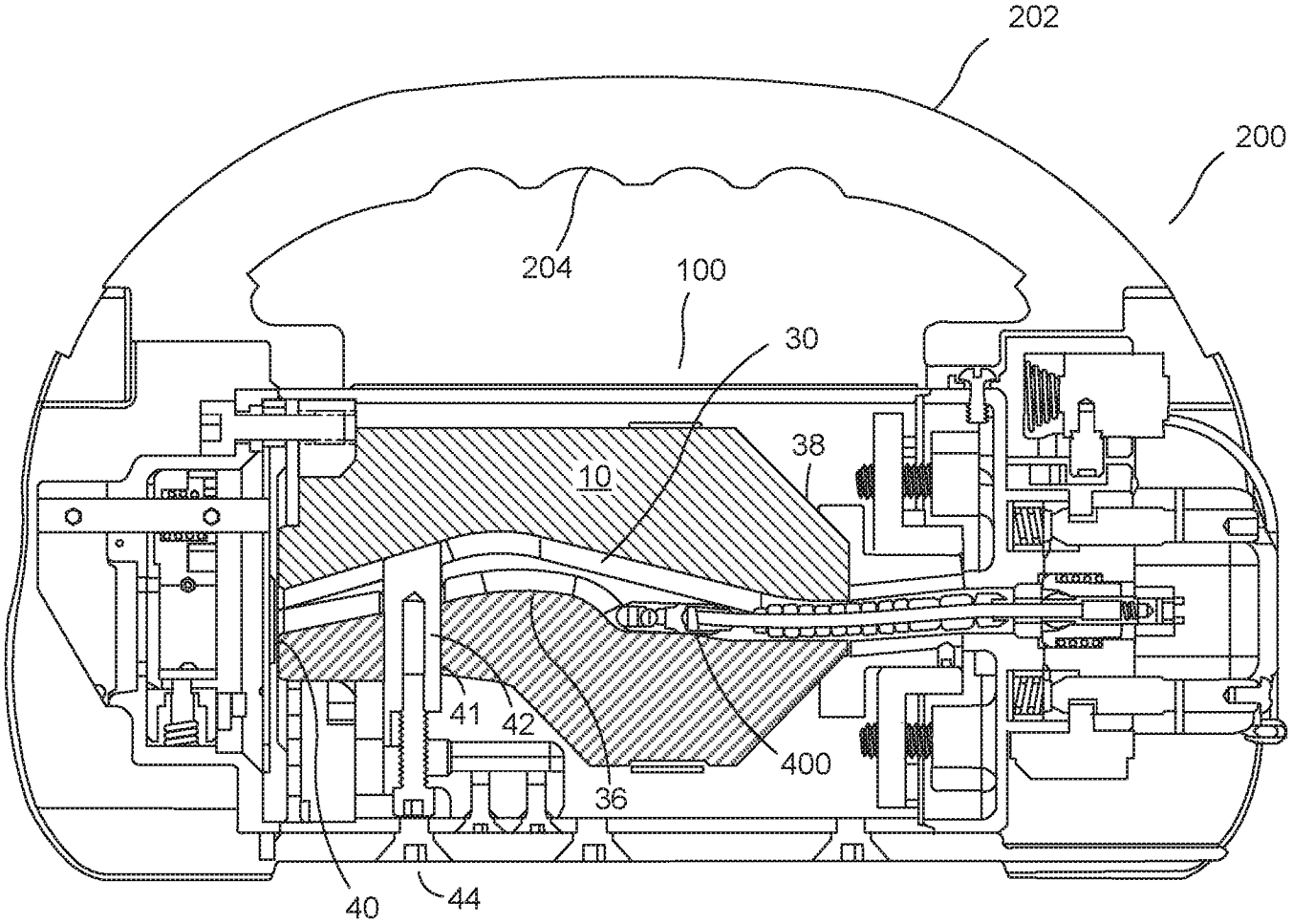
FIG. 4 is an illustration of a radiological device, including an embodiment of the shutter mechanism used in combination with the source path of FIG. 3.
Figure 5:
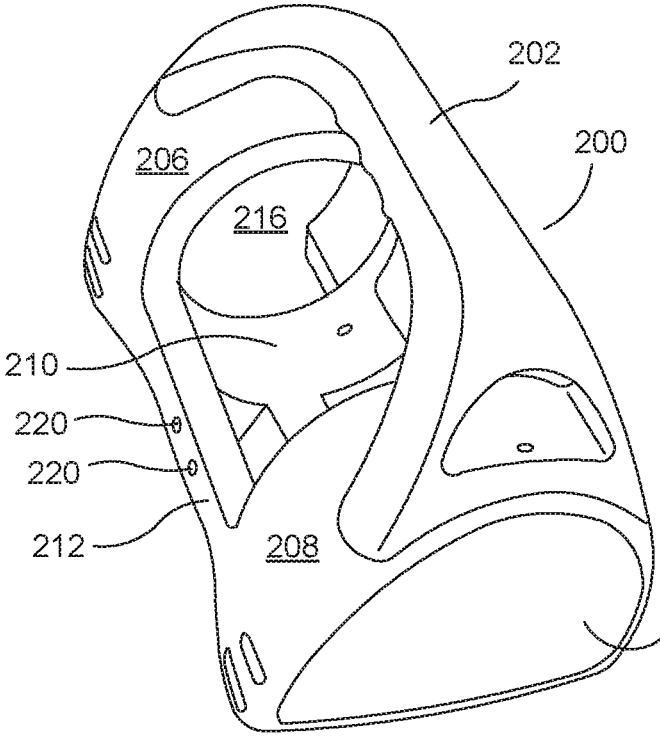
FIG. 5 is a perspective view of an embodiment of molded polymer protective jackets.

FIGS. 3 and 4 relate to a shield 10 with a radiological shutter mechanism 42. FIG. 3 illustrates a shield 10 (such as illustrated in FIGS. 1A and 1B), typically made of tungsten, including an S-shaped passageway forming source path 30. It is noted that due to the upward rise 36 in S-shaped passageway or source path 30, that there is no direct or straight open path (i.e., line of sight) between the first end 38 and the second end 40 of source path 30, thereby providing radiological shielding between the first and second ends 38, 40, particularly in view of the preferred tungsten composition of shield 10. FIG. 4 illustrates a radiological device 100 (engaged by a protective jacket 200 as illustrated in FIGS. 6-9), including the modified S-tube source path 30 in combination with a radiological shutter mechanism 42, typically made from tungsten, travelling vertically (in the illustrated orientation) through shaft 43 formed in source path 28. The shutter mechanism 42 is typically manually operated by screw 44 extending through the bottom surface of the shield 10 through passageway 41. The "lazy-S" source path 30 provides shielding adequate when the projector front plate or collimator assembly is attached. The shutter mechanism 42 is typically operated to provide shielding of radiological source 400 during a mode change (for example, from a projector front plate to a collimator assembly) of the gamma radiography device 100. Typically, the primary purpose of the radiological shutter mechanism 42 is to reduce gamma radiation scatter from leaving the source path 30 when the radiographer is changing the device from SCAR (small contained area radiography) mode to projector mode.

The S-shaped design, including the upward rise 36 in passageway 30, is intended to provide sufficient shielding to prevent a direct path of radiation from leaving the source path 30, such as from radiological source 400, through second end 40 of source path 30, as illustrated in FIG. 4. This in combination with the shutter mechanism 42 (during the mode change) provides an approach to shield design. The shutter mechanism 42 is used typically to provide shielding only during the mode change.

This embodiment exploits the benefits of the shielding of the SCAR assembly and the projector front plate assembly.

Figure 6:
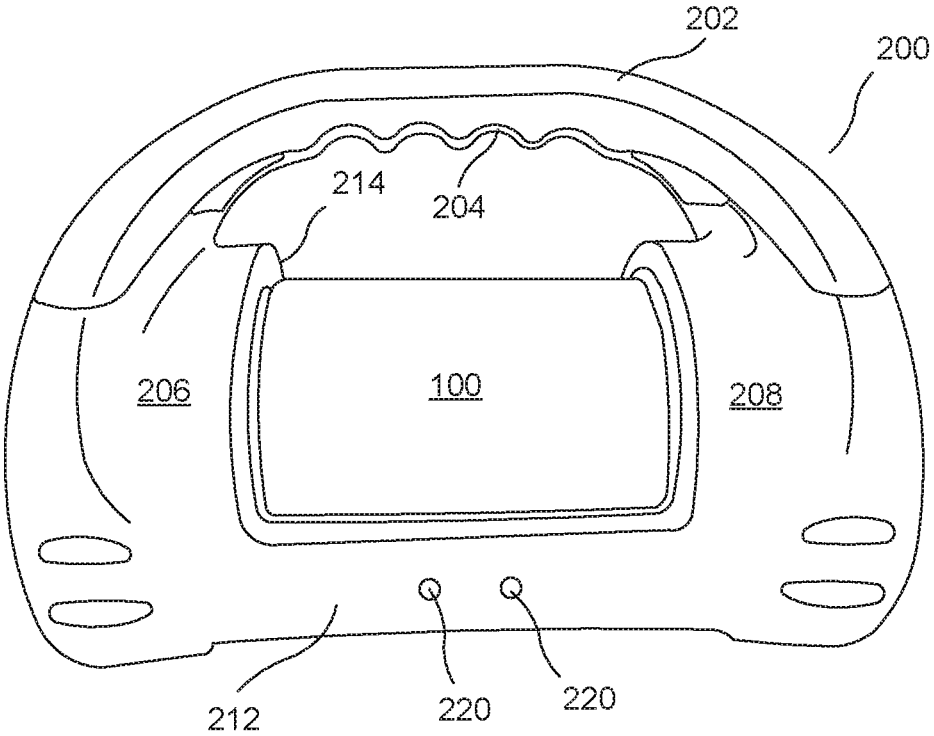
FIG. 6 is a perspective view of an embodiment of a gamma radiography device with the molded polymer jacket of FIG. 5.
Figure 7:
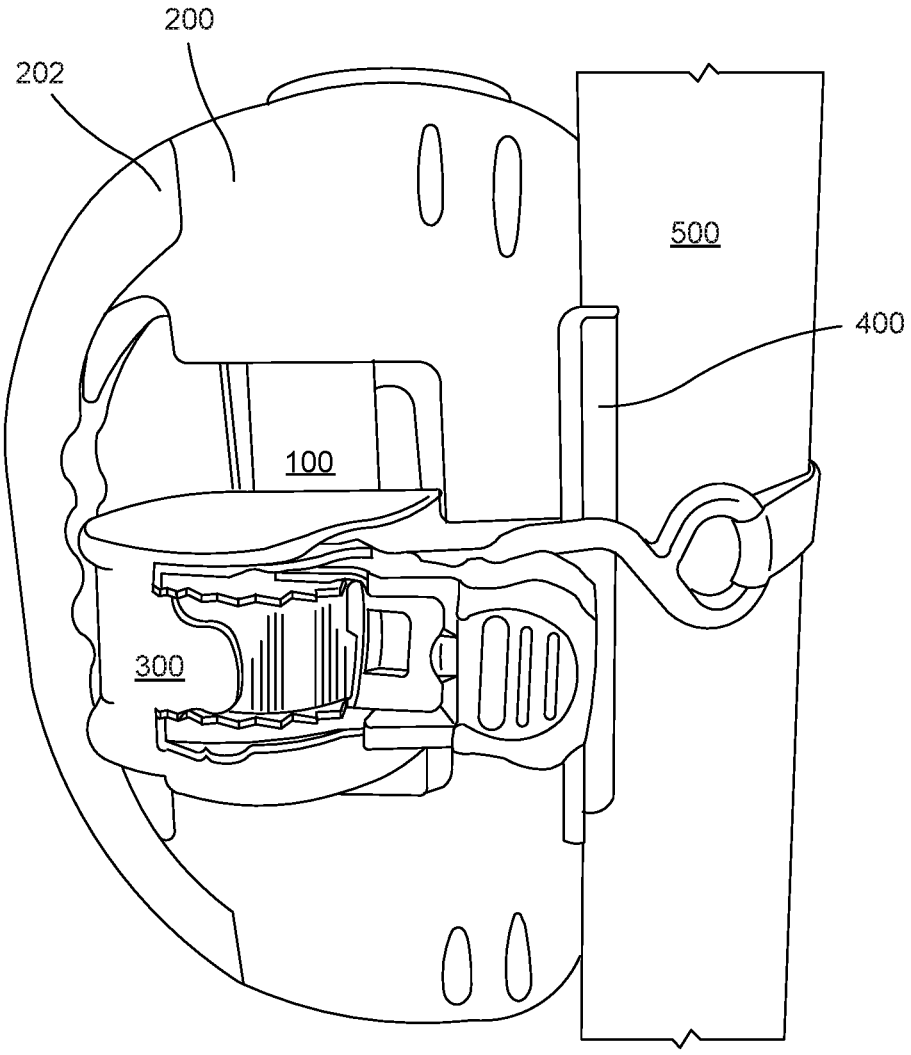
FIG. 7 is a perspective view of an embodiment of a gamma radiation device with the molded polymer protective jacket of FIGS. 5 and 6, shown using SCAR (small contained area radiography) mounting features.
Figure 8:
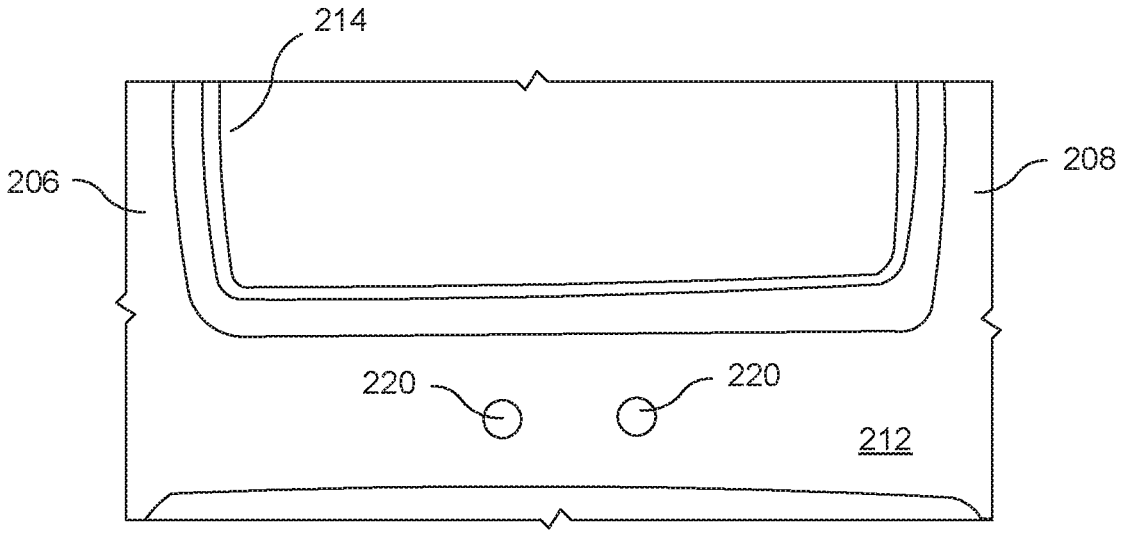
FIG. 8 is a detailed side view of an embodiment of the molded polymer protective jacket, showing the mounting apertures for a ratchet strap.
Figure 9:
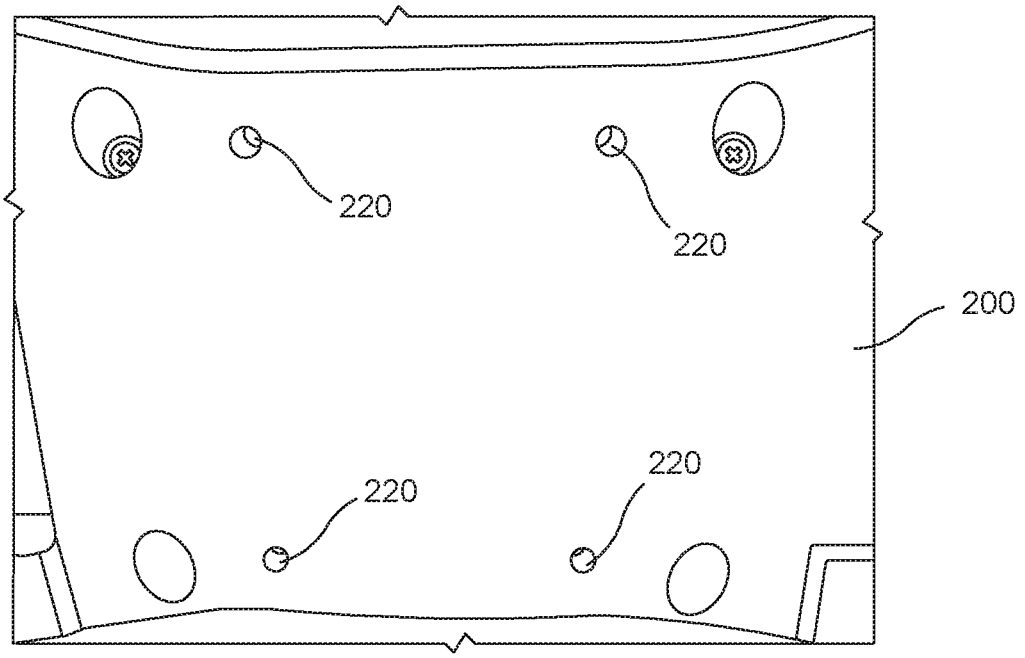
FIG. 9 is a detailed bottom view of an embodiment of the molded polymer protective jacket, showing the mounting apertures for a SCAR feature.

FIGS. 5-9 relate to an embodiment of a protective jacket 200 for a gamma radiography device 100 (the protective jacket 200 is likewise illustrated in FIG. 4). FIGS. 6 and 7 relate to a polymer molded jacket 200 that is used as a protective cover as well as a device for carrying the radiography device 100. The protective jacket 200 includes handle 202 including interior oriented molded finger indentations 204. First and second ring configurations 206, 208 form a cylindrical space 210 for engaging a radiological device 100. A lower floor 212, which may be partially cylindrical) joins first and second ring Configurations 206, 208 and an open space 214 is formed between the upper portions of first and second ring configurations 206, 208 in order to provide access to the controls of radiological device 100. Further, the end of first ring configuration 206 includes an opening 216 through which radiological device 100 passes to be engaged or disengaged by the protective jacket 200. Second ring configuration 208 includes a closed end wall 218 to secure the radiological device 100. As shown in FIGS. 7-9, the illustrated protective jacket 200 further allows for mounting features when operating the radiological device 100 as a SCAR unit. By using a molded polymer-based protective jacket 200 rather than the industry standard of a simple metal handle, the illustrated embodiment of the protective jacket 200 allows for integrated SCAR mounting features such as mounting apertures 220 on a side of lower floor 212 (see FIG. 8) for a ratchet snap configuration 300 or other fixture kits, FIG. 7 further illustrates a SCAR mounting fixture 400 which includes a first side which is attached to the bottom of the lower floor 212 of protective jacket 200 via the. mounting apertures 220 (see FIG. 9) on the bottom of the protective jacket 200, The SCAR mounting fixture 400 further includes a second side for engaging against the curved surface of the pole 500 (which may be an architectural fixture) or similar structure. This protective jacket 200 further provides a more ergonomic product as compared to prior art protective jackets.

Thus the several aforementioned objects and advantages are most effectively attained. Although preferred embodiments of the invention have been disclosed and described in detail herein, it should be understood that this invention is in no sense limited thereby.

What is claimed is:

1. A radiographic shield comprising:

a first half presenting a first face;

a second half presenting a second face, the second face being engaged against the first face in a first position and being separated from the first face in a second position;

wherein the first half includes a first convex curved protrusion and a first concave curved undercut recess and the second half includes a second convex curved protrusion and a second concave curved undercut recess, wherein, in the first position, the first convex curved protrusion is engaged within the second concave curved undercut recess and the second protrusion is engaged within the first concave curved undercut recess whereby the first half and the second half have a single degree of freedom of relative motion; and a passageway formed between the first face and the second face, the passageway including a first end opening and a second end opening, the passageway including a circuitous element wherein there is no line of sight between the first end opening and the second end opening, the passageway including a portion for shielding a radiographic source prior to projecting the radiographic source during a projector mode.

2. The radiographic shield of claim 1 wherein the first and second halves are comprised of tungsten.

3. The radiographic shield of claim 1 wherein the first half and the second half are manufactured from a single block of material using electrical discharge machining.

4. The radiographic shield of claim 1 wherein the circuitous element includes a central portion of the passageway which rises upwardly to prevent a line of sight between the first end opening and the second end opening.

5. The radiographic shield of claim 1 wherein the circuitous element includes an at least partially S-shaped element.

6. The radiographic shield of claim 1 further including a radiographic shutter mechanism for selectively opening and closing the passageway.

7. The radiographic shield of claim 6 wherein the radiographic shutter is made from tungsten.

8. The radiographic shield of claim 6 wherein the radiographic shutter is manually operated.

9. The radiographic shield of claim 8 further including a screw for manual operation of the radiographic shutter.

* * * * *